US011730242B1

(12) United States Patent
Peng

(10) Patent No.: US 11,730,242 B1
(45) Date of Patent: Aug. 22, 2023

(54) CARD CLIP

(71) Applicant: Qiyong Peng, Yichun (CN)

(72) Inventor: Qiyong Peng, Yichun (CN)

( * ) Notice: Subject to any disclaimer, the term of this patent is extended or adjusted under 35 U.S.C. 154(b) by 0 days.

(21) Appl. No.: 18/124,679

(22) Filed: Mar. 22, 2023

(51) Int. Cl.
*A45C 1/06* (2006.01)
*A45C 13/18* (2006.01)

(52) U.S. Cl.
CPC ..... *A45C 1/06* (2013.01); *A45C 13/185* (2013.01); *A45C 2001/065* (2013.01); *A45C 2001/067* (2013.01)

(58) Field of Classification Search
CPC ... A45C 1/06; A45C 13/185; A45C 2001/065; A45C 2001/067
USPC ..... 24/67.3, 67.9
See application file for complete search history.

(56) References Cited

U.S. PATENT DOCUMENTS 773,392 A * 10/1904 Holsapple ..... A45C 1/06 281/38
4,903,376 A * 2/1990 Rousseau ..... B42F 1/00 150/137
5,944,080 A * 8/1999 Podwika ..... A45C 11/182 150/147
6,327,749 B1 * 12/2001 Antinone ..... B42F 1/006 24/67.5
9,475,197 B1 * 10/2016 McAuley ..... B25B 9/02
11,278,092 B2 * 3/2022 Grafilo ..... A45C 1/06
2013/0276943 A1 * 10/2013 Minn ..... A45C 1/06 150/137
2015/0083289 A1 * 3/2015 Johnson ..... A45C 1/06 150/144
2016/0073747 A1 * 3/2016 Whichel ..... A45C 13/02 150/118
2016/0324283 A1 * 11/2016 Kane ..... A45C 11/182
2017/0119115 A1 * 5/2017 King ..... A45C 1/06
2018/0368544 A1 * 12/2018 King ..... A45C 11/182
2019/0269213 A1 * 9/2019 Deng ..... A45C 11/182
2021/0337945 A1 * 11/2021 Popoff ..... A45C 13/1069
2022/0400823 A1 * 12/2022 Clarete ..... A45C 1/06

* cited by examiner

*Primary Examiner* — John K Fristoe, Jr.
*Assistant Examiner* — Justin Caudill
(74) *Attorney, Agent, or Firm* — Daniel M. Cohn; Howard M. Cohn

(57) ABSTRACT

A card clip configured to accommodate card includes an upper clamping plate, a lower clamping plate, and two elastic bands. The upper clamping plate includes two first portions arranged opposite to each other. The lower clamping plate is arranged opposite to the upper clamping plate. The lower clamping plate includes two second portions arranged opposite to each other. The two second portions are respectively corresponding to the two first portions. The two elastic bands are arranged on two opposite sides of the card clip. A first end of each of the elastic bands is fixedly arranged in a corresponding first portion, and a second end of each of the elastic bands is fixedly arranged in a corresponding second portion.

19 Claims, 9 Drawing Sheets

CARD CLIP

TECHNICAL FIELD

The present disclosure relates to a technical field of daily necessities, and in particular to a card clip.

BACKGROUND

In daily life, there are many scenarios that require using cards. For example, many users usually use deposit cards or credit cards for card purchases, use ID cards for travel or business, use social security cards or health insurance cards for hospital visits, etc. Although wallets can be used to receive these cards, the wallets are large and inconvenient to carry around at all times. In the prior art, many users use card clips to receive cards. A size of a card clip is much smaller than a size of a wallet. However, the card clips in the prior art are inconvenient when picking up the cards.

SUMMARY

The present disclosure provides a card clop, in which an upper clamping plate is connected to a lower clamping plate by two elastic bands. An opening angle of the upper clamping plate with respect to the lower clamping plate is adjusted by the two elastic bands, which facilitate a user to take out or put in cards.

One embodiment of the present disclosure provides the card clip configured to accommodate cards. The card clip comprises an upper clamping plate, a lower clamping plate, and two elastic bands.

The upper clamping plate comprises two first portions arranged opposite to each other. The lower clamping plate is arranged opposite to the upper clamping plate. The lower clamping plate comprises two second portions arranged opposite to each other. The two second portions are respectively corresponding to the two first portions.

The two elastic bands are arranged on two opposite sides of the card clip. A first end of each of the elastic bands is fixedly arranged in a corresponding first portion, and a second end of each of the elastic bands is fixedly arranged in a corresponding second portion.

In some embodiments, the upper clamping plate comprises a first upper cover plate and a first lower cover plate.

The card clip further comprises two first fixing shafts. Each of the first fixing shafts is fixedly arranged between the first upper cover plate and the first lower cover plate. The first end of each of the elastic bands defines a first sleeving portion. Each first sleeving portion is sleeved on a corresponding first fixing shaft.

In some embodiments, the first lower cover plate comprises a first bottom portion and two first protrusion portions. The two first protrusion portions are arranged on two opposite sides of the first bottom portion to form a first groove. The first end of each of the elastic bands is arranged in the first groove.

Each of the first protrusion portions defines two first accommodating ports opposite to each other. Each of the first accommodating ports is corresponding to a corresponding first fixing shaft. Two ends of each of the first fixing shafts extend from a corresponding elastic band and are separately clamped in a corresponding first accommodating port.

In some embodiments, an accommodating groove is defined on the first bottom portion. The first upper cover plate covers the accommodating groove.

In some embodiments, accommodating through holes are defined on the first bottom portion. The accommodating through holes are corresponding to the accommodating groove.

In some embodiments, the card clip further comprises a decorative piece. The decorative piece is accommodated in the accommodating groove.

In some embodiments, the card clip further comprises an electronic tag. The electronic tag is arranged in the accommodating groove.

In some embodiments, the upper clamping plate further comprises an annular protrusion. The annular protrusion is arranged on one side of the first upper cover plate away from the first lower cover plate. The annular protrusion is arranged corresponding to the accommodating groove.

In some embodiments, the upper clamping plate further comprises a plurality of first fixing pieces. The first upper cover plate is fixedly connected to the first lower cover plate by the plurality of first fixing pieces.

In some embodiments, the upper clamping plate further comprises an annular protrusion. The annular protrusion is arranged on one side of the first upper cover plate away from the first lower cover plate. The annular protrusion and the first upper cover plate form a storage groove.

In some embodiments, the lower clamping plate comprises a second upper cover plate and a second lower cover plate. The card clip further comprises two second fixing shafts, each of the second fixing shafts is fixedly arranged between the second upper cover plate and the second lower cover plate. The second end of each of the elastic bands defines a second sleeving portion. Each second sleeving portion is sleeved on a corresponding second fixing shaft.

In some embodiments, the second upper cover plate comprises a second bottom portion and two second protrusion portions. The two second protrusion portions are arranged on two opposite sides of the second bottom portion to form a second groove. The second end of each of the elastic bands is arranged in the second groove.

Each of the second protrusion portions defines two second accommodating ports opposite to each other. Each of the second accommodating ports is corresponding to a corresponding second fixing shaft. Two ends of each of the second fixing shafts extend from a corresponding elastic band and are separately clamped in a corresponding second accommodating port.

In some embodiments, two ends of the first lower cover plate define first notches. Two ends of the second upper cover plate define second notches. Each of the elastic bands passes through a corresponding first notch and a corresponding second notch, so that each of the elastic bands does not exceed the first upper cover plate and the second lower cover plate.

In some embodiments, the lower clamping plate further comprises a clamping structure. The clamping structure is arranged on one side of the second lower cover plate away from the second upper cover plate. A first end of the clamping structure is fixedly connected to the second lower cover plate. A second end of the clamping structure elastically abuts against the second lower cover plate.

In some embodiments, the lower clamping plate further comprises a plurality of second fixing pieces. The second upper cover plate is fixedly connected to the second lower cover plate by the plurality of second fixing pieces.

In some embodiments, the upper clamping plate comprises two first end portions arranged opposite to each other.

Each of the first end portions defines a first opening. Each of the elastic bands passes through a corresponding first opening.

The lower clamping plate comprises two second end portions arranged opposite to each other. Each of the second end portions defines a second opening. Each of the elastic bands passes through a corresponding second opening.

In some embodiments, an edge of the upper clamping plate defines a first card taking notch configured to expose parts of the cards.

In some embodiments, an edge of the lower clamping plate defines a second card taking notch arranged corresponding to the first card taking notch.

In some embodiments, an edge of the lower clamping plate defines a second card taking notch configured to expose parts of the cards.

In some embodiments, each of the elastic bands is selected from an elastic webbing, a silicone elastic band, a latex elastic band, and a rubber elastic band.

In the embodiments of the present disclosure, each of the elastic bands is arranged on two opposite sides of the card clip. The first end of each of the elastic bands is fixed in the corresponding first portion of the upper clamping plate, and the second end of each of the elastic bands is fixed in the corresponding second portion of the lower clamping plate. Since the elastic bands have good elasticity and are stretchable for a long distance, the upper clamping plate is openable with respect to the lower clamping plate at a large angle by the two elastic bands, which is convenient for the user to put the cards between the upper clamping plate and the lower clamping plate and is convenient for the user to take out the cards clamped between the upper clamping plate and the lower clamping plate.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

For a complete understanding of the present disclosure and its characteristics, the following description will be made in conjunction with the accompanying drawings, where same reference numbers in the following description indicate same structures.

In the drawings.

1—card clip, 10—upper clamping plate, 11—first end portion, 111—first opening, 12—first portion, 13—first card taking notch, 14—first upper cover plate, 16—first lower cover plate, 162—first bottom portion, 163—first notch, 164—first protrusion portion, 1642—first accommodating port, 165—first groove, 167—accommodating groove, 1672—accommodating through hole, 18—first fixing piece, 19—annular protrusion, 191—storage groove.

20—lower clamping plate, 21—second end portion, 211—second opening, 22—second portion, 23—second card taking notch, 24—second upper cover plate, 242—second bottom portion, 244—second protrusion portion, 2442—second accommodating port, 245—second groove, 247—second notch, 26—second lower cover plate, 28—clamping structure, 29—second fixing piece.

32—elastic band, 322—first sleeving portions, 324—second sleeving portions, 34—first fixing shafts, 36—second fixing shafts, 38—steel plate.

42—decorative piece, 44—Electronic tag.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Figure 1:
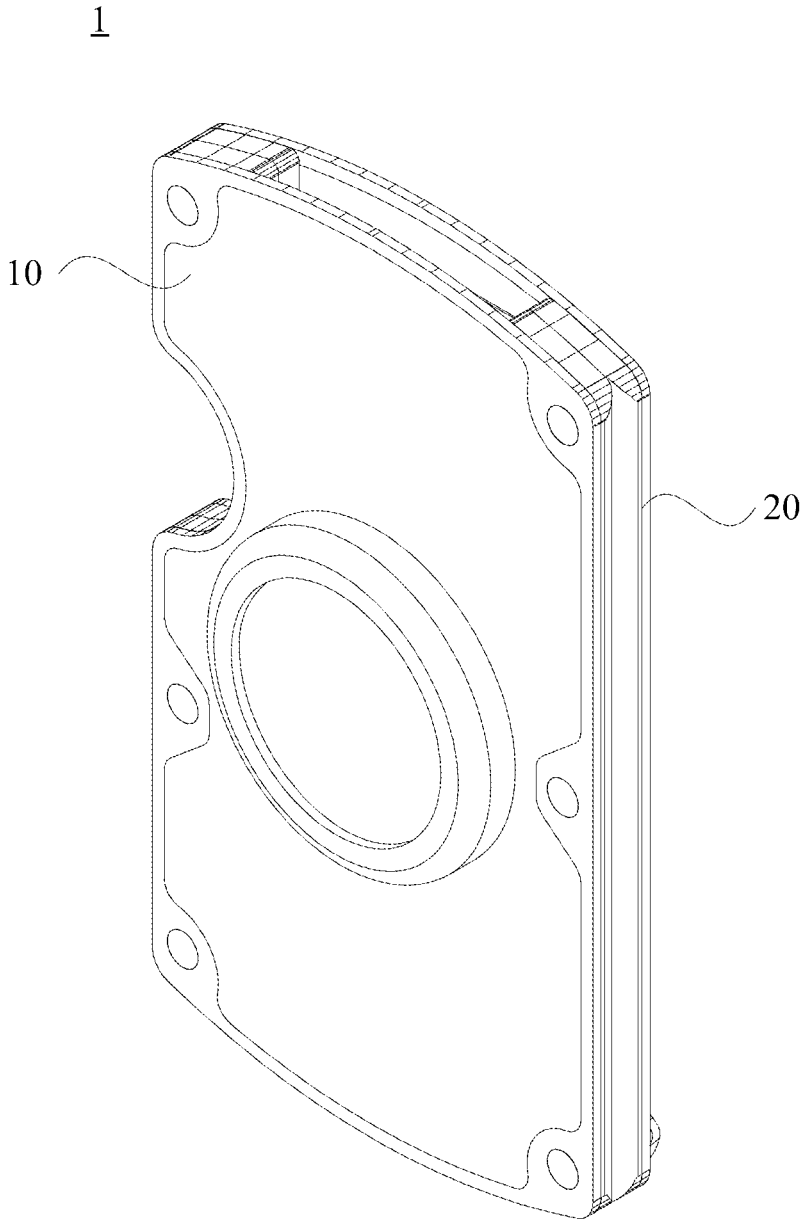
FIG. 1 is a schematic diagram of a card clip according to one embodiment of the present disclosure.
Figure 2:
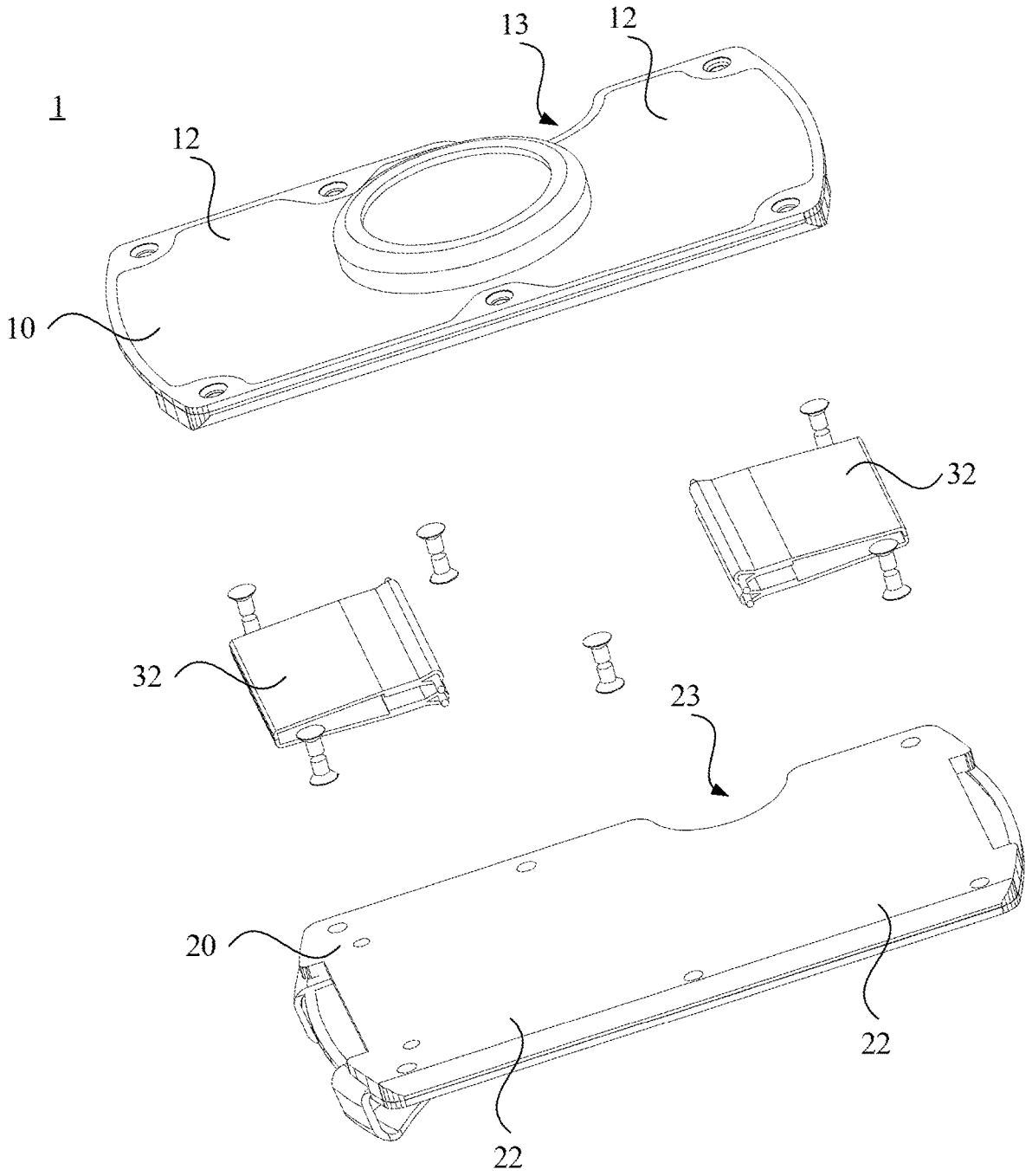
FIG. 2 is an exploded schematic diagram of the card clip shown in FIG. 1.

One embodiment of the present disclosure provides a card clip 1, as shown in FIGS. 1 and 2, FIG. 1 is a schematic diagram of the card clip according to one embodiment of the present disclosure and FIG. 2 is an exploded schematic diagram of the card clip shown in FIG. 1. The card clip 1 is configured to accommodate cards. The card clip 1 comprises an upper clamping plate 10, a lower clamping plate 20, and two elastic bands 32. The upper clamping plate 10 comprises two first portions 12 arranged opposite to each other. The lower clamping plate 20 is arranged opposite to the upper clamping plate 10. The lower clamping plate 20 comprises two second portions 22 arranged opposite to each other. The two second portions 22 are respectively corresponding to the two first portions 12.

The two elastic bands 32 are arranged on two opposite sides of the card clip 1. A first end of each of the elastic bands 32 is fixedly arranged in a corresponding first portion 12, and a second end of each of the elastic bands 32 is fixedly arranged in a corresponding second portion 22.

One of the first portions of the upper clamping plate 10 and one of the second portions of the lower clamping plate 20 that connected to a same elastic band 32 are arranged on a same side of the card clip 1. A first one of the first portions of the upper clamping plate 10 and a first one of the second portions of the lower clamping plate 20 connected to a first elastic band 32 are arranged on an upper side of the card clip 1. A second one of the first portions of the upper clamping plate 10 and a second one of the second portions of the lower clamping plate 20 connected to a second elastic band 32 are arranged on a lower side of the card clip 1.

Each of the elastic bands 32 is respectively arranged on two opposite sides of the card clip 1. The first end of each of the elastic bands 32 is fixed in the corresponding first portion 12 of the upper clamping plate 10, and the second end of each of the elastic bands 32 is fixed in the corresponding second portion 22 of the lower clamping plate 20. Since the elastic bands 32 have good elasticity and are stretchable for a long distance, the upper clamping plate 10 is openable with respect to the lower clamping plate 20 at a large angle by the two elastic bands 32, which is convenient for a user to put the cards between the upper clamping plate 10 and the lower clamping plate 20 and is convenient for the user to take out the cards clamped between the upper clamping plate 10 and the lower clamping plate 20.

In one embodiment, the card clip 1 defines a length direction. The two elastic bands 32 are spaced apart along the length direction of the card clip 1. The first one of the first portions 12 of the upper clamping plate 10 and the first one of the second portions of the lower clamping plate 20 are connected to a first elastic band 32. The second one of the first portions of the upper clamping plate 10 and the second one of the second portions of the lower clamping plate 20 are connected to the second elastic band 32. The user can put in or take out the cards from the length direction of the card clip 1. For example, each card may comprise a long side and a short side, and a length of the long side of each card is greater than a length of the short side of each side. The long side of each card extends along the length direction of the card clip 1, and the short side of each card extends along a width direction of the card clip 1. The elastic bands 32 are connected at a short side of the card clip 1, and the cards can be take out or put into the card clip from a long side of the card clip 1.

In other embodiments, the card clip 1 defines a width direction, and the two elastic bands are spaced along the width direction of the card clip. The first one of the first portions of the upper clamping plate 10 is connected to the first one of the second portions of the lower clamping plate 20 through the first elastic band 32. The second one of the first portions of the upper clamping—plate 10 is connected to the second one of the second portions of the lower clamping plate 20 through the second elastic band 32. The user can put in or take out the cards from the width direction of the card clip 1. For example, each card may include the long side and the short side, and the length of the long side of each card is greater than the length of the short side of each side. The long side of each card extends along the length direction of the card clip 1, and the short side of each card extends along the width direction of the card clip 1. The elastic bands 32 are connected at the long side of the card clip 1, and the cards can be take out or put into the card clip from the short side of the card clip 1.

Figure 3:
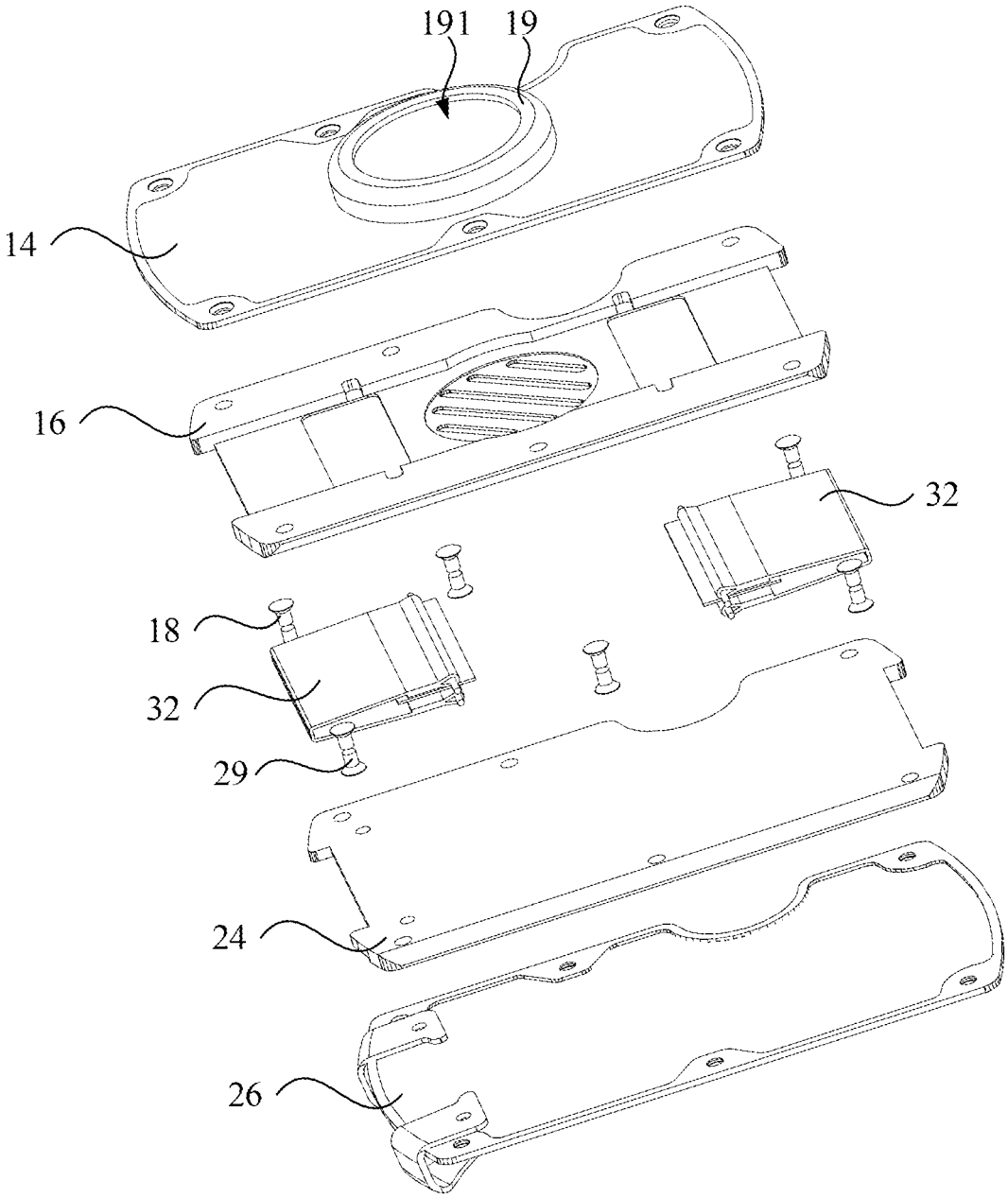
FIG. 3 is another exploded schematic diagram of the card clip shown in FIG. 1.
Figure 4:
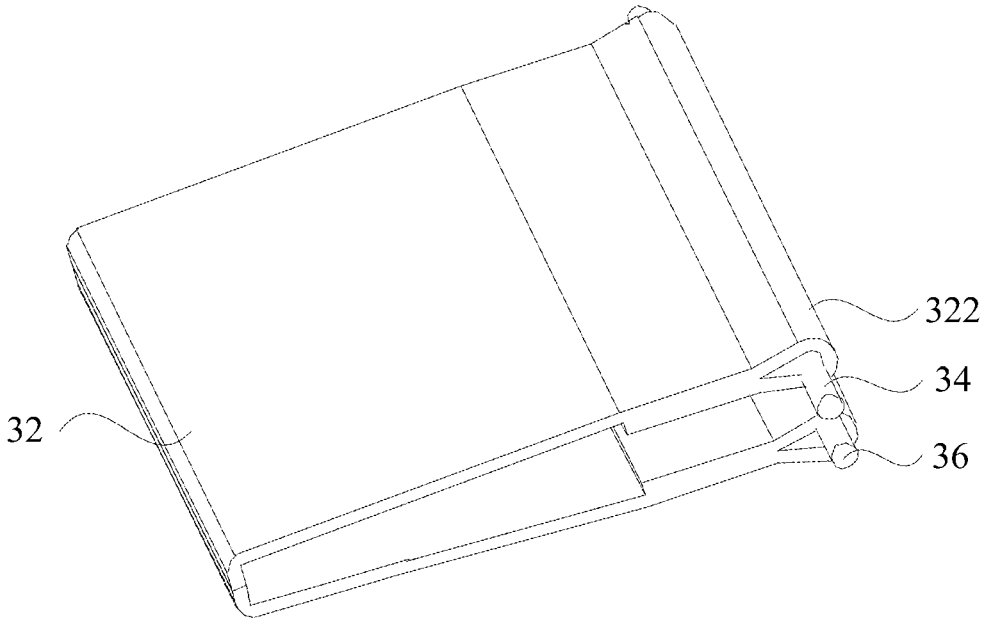
FIG. 4 is a schematic diagram of an elastic band and matching structure thereof of the card clip shown in FIG. 3.

As shown in FIGS. 3 and 4, FIG. 3 is another exploded schematic diagram of the card clip shown in FIG. 1 and FIG. 4 is a schematic diagram of one elastic band and matching structure thereof of the card clip shown in FIG. 3. In some embodiments, the upper clamping plate 10 comprises a first upper cover plate 14 and a first lower cover plate 16. The card clip 1 further comprises two first fixing shafts 34. Each of the first fixing shafts 34 is fixedly arranged between the first upper cover plate 14 and the first lower cover plate 16. The first end of each of the elastic bands 32 defines a first sleeving portion 322. Each first sleeving portion 322 is sleeved on a corresponding first fixing shaft 34.

The first fixing shafts 34 are fixedly arranged between the first upper cover plate 14 and the first lower cover plate 16. The first end of each of the elastic bands 32 defines the first sleeving portion 322. Each first sleeving portion 322 is sleeved on the corresponding first fixing shaft 34, so that the first end of each of the elastic bands 32 is arranged in the upper clamping plate 10. The two first fixing shafts 34 are respectively arranged in the two first portions 12 of the upper clamping plate 10. Correspondingly, the first end of each of the elastic bands 32 is fixed in the corresponding first portion 12 of the upper clamping plate 10.

Specifically, the first end of each of the elastic bands 32 may be partially overlapped to form each first sleeving portion 322. An area of an overlapping portion of each of the elastic bands 32 close to the second end thereof is fixedly connected to the elastic band thereof. An area of the overlapping portion of each of the elastic bands 32 away from the second end thereof is configured to sleeve a corresponding first fixing shaft 34. The area of the overlapping portion of each of the elastic bands 32 close to the second end thereof is fixedly connected to the elastic band thereof by stitching, gluing, hot-melt fixing, etc.

Figure 5:
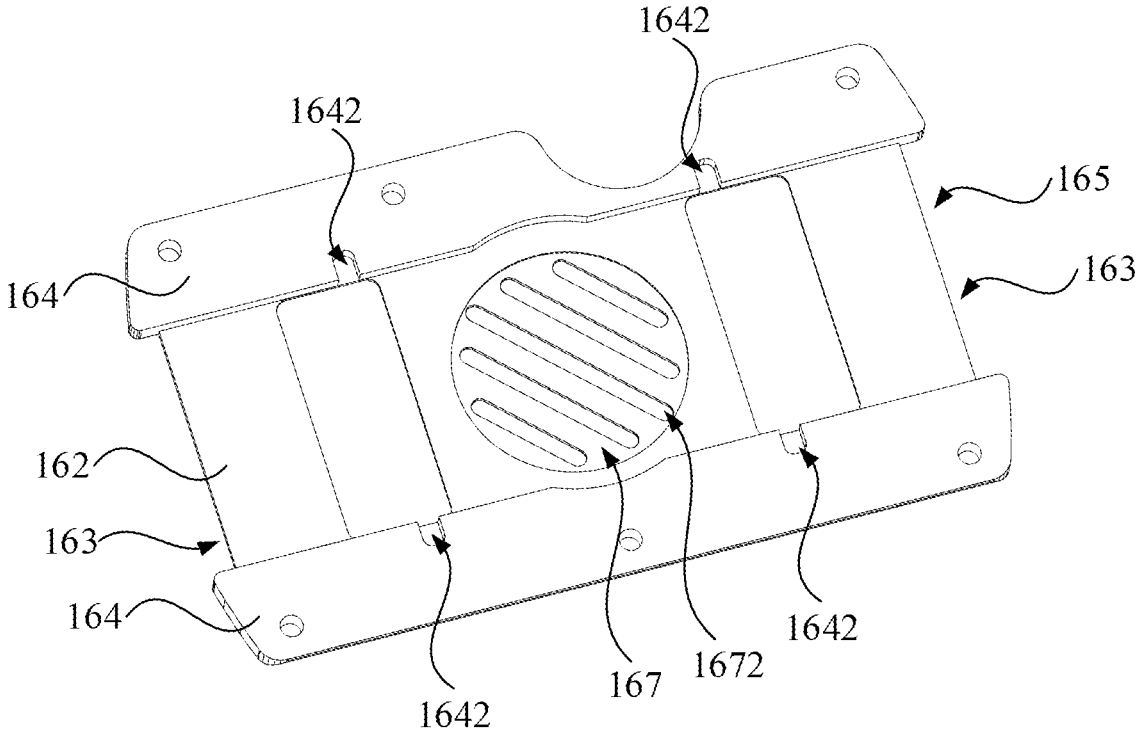
FIG. 5 is a schematic diagram of a first lower cover plate of the card clip shown in FIG. 3.

As shown in FIG. 5, FIG. 5 is a schematic diagram of the first lower cover plate of the card clip shown in FIG. 3. In some embodiments, the first lower cover plate 16 comprises a first bottom portion 162 and two first protrusion portions 164. The two first protrusion portions 164 are arranged on two opposite sides of the first bottom portion 162 to form a first groove 165. The first end of each of the elastic bands 32 is arranged in the first groove 165, so each of the elastic bands 32 are well arranged in the upper clamping plate 10 while not affecting elastic stretch of the elastic band 32. Each of the first protrusion portions 164 defines two first accommodating ports 1642 opposite to each other. Each of the first accommodating ports 1642 is corresponding to a corresponding first fixing shaft 34. Two ends of each of the first fixing shafts 34 extend from a corresponding elastic band 32 and are separately clamped in a corresponding first accommodating port 1642. Thus, the first fixing shafts 34 are stably and reliably fixed between the first lower cover plate 16 and the first upper cover plate 14.

It should be understood that each two first accommodating ports 1642 arranged opposite to each other have a certain distance from an edge of the first bottom portion 162, i.e., a portion of each of the elastic bands 32 arranged in the upper clamping plate 10 has a certain length. When the upper clamping plate 10 and the lower clamping plate 20 are opened through the elastic bands 32, a length of each of the elastic bands 32 being stretched is fixed. The longer each of the elastic bands 32 is, the longer a stretching length of each of the elastic bands 32 is, which is convenient for the user to open the card clip for a large angle, and prevents the elastic bands 32 from excessively stretching to protect the elastic bands 32.

An accommodating groove 167 is defined on the first bottom portion 162. The first upper cover plate 14 covers the accommodating groove 167. The accommodating groove 167 is configured to accommodate some special items. In some embodiments, accommodating through holes 1672 are defined on the first bottom portion, and the accommodating through holes 1672 are corresponding to the accommodating groove 167. When the upper clamping plate 10 and the lower clamping plate 20 are open, the special items accommodated in the accommodating groove 167 are visible through the accommodating through holes 1672. In other embodiments, a position of the first bottom portion 162 corresponding to the accommodating groove 167 does not define the accommodating through holes 1672 and the position of the first bottom portion 162 corresponding to the accommodating groove 167 is flat.

Figure 6:
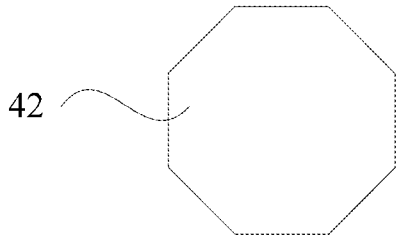
FIG. 6 is a schematic diagram of a decorative piece according to one embodiment of the present disclosure.
Figure 7:
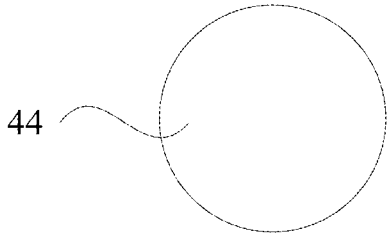
FIG. 7 is a schematic diagram of an electronic tag according to one embodiment of the present disclosure.

As shown in FIG. 6, FIG. 6 is a schematic diagram of a decorative piece according to one embodiment of the present disclosure. In some embodiments, the card clip 1 further comprises the decorative piece 42. The decorative piece 42 is accommodated in the accommodating groove 167. The decorative piece 42 may be an electronic decorative piece 42, such as a lamp capable of emitting light with one or more colors, a speaker capable of playing audios, and the like. The decorative piece 42 may also be a non-electronic decorative piece 42, such as a picture, an ornament, etc. As shown in FIG. 7, FIG. 7 is a schematic diagram of an electronic tag according to one embodiment of the present disclosure. In some embodiments, the card clip 1 further comprises an electronic tag 44. The electronic tag 44 is arranged in the accommodating groove 167. The user is able to obtain related information of the card clip 1 through the electronic tag 44, such as a position of the card clip 1, information of the cards stored in the card clip 1, and other information provided by the electronic tag 44.

As shown in FIG. 3, in some embodiments, the upper clamping plate 10 further comprises a plurality of first fixing pieces 18. The first upper cover plate 14 is fixedly connected to the first lower cover plate 16 by the plurality of first fixing pieces 18. The plurality of first fixing pieces 18 may be arranged according to requirements. For example, the plurality of first fixing pieces 18 may be screws, rivets, or other components. For example, the first upper cover plate 14 and the first lower cover plate 16 correspondingly define threaded holes, and the screws are screwed to connect the threaded holes of the first upper cover plate 14 with the threaded holes of the first lower cover plate 16, thereby fixedly connecting the first upper cover plate 14 with the first lower cover plate 16. Alternatively, through holes are defined on the first upper cover plate 14 and threaded holes corresponding to the through holes are defined on the first lower cover plate 16. The screws respectively pass through the through holes of the first upper cover plate 14 and are respectively screwed with the threaded holes of the first lower cover plate 16, thereby fixedly connecting the first upper cover plate 14 with the first lower cover plate 16.

In some embodiments, the first upper cover plate 14 is detachably connected to the first lower cover plate 16, and the first upper cover plate 14 and the first lower cover plate 16 are detachable. Therefore, the electronic tag 44 or the decorative piece 42 is able to be put into the accommodating groove 167, or the electronic tag 44 or the decorative piece 42 is able to be removed from the accommodating groove 167.

In some other embodiments, the first upper cover plate 14 is fixedly connected to the first lower cover plate 16. In a production process of the card clip 1, the electronic tag 44 or the decorative piece 42 is put into the accommodating groove 167 in advance, and then the first upper cover plate 14 is fixedly connected to the first lower cover plate 16.

In some embodiments, the upper clamping plate 10 further comprises an annular protrusion 19. The annular protrusion 19 is arranged on one side of the first upper cover plate 14 away from the first lower cover plate 16. The annular protrusion 19 is arranged corresponding to the accommodating groove 167. The first upper cover plate 14 defines an opening corresponding to the accommodating groove 167, and a space enclosed by the annular protrusion 19 is communicated with the accommodating groove 167 to define a relative deep accommodating space for accommodating a thick item.

In some embodiments, the upper clamping plate 10 further comprises the annular protrusion 19. The annular protrusion 19 is arranged on one side of the first upper cover plate 14 away from the first lower cover plate 16. The annular protrusion 19 and the first upper cover plate 14 form a storage groove 191. The storage groove 191 is exposed on an outer side of the card clip 1, so that the item such as the decorative piece 42 or the electronic tag 44 is conveniently placed into the storage groove 191. The annular protrusion 19 protects the item accommodated in the storage groove 191 and prevents the item from being damaged or fall off from the card clip 1.

As shown in FIGS. 3 and 4, the lower clamping plate 20 comprises a second upper cover plate 24 and a second lower cover plate 26. The card clip 1 further comprises two second fixing shafts 36. Each of the second fixing shafts 36 is fixedly arranged between the second upper cover plate 24 and the second lower cover plate 26. The second end of each of the elastic bands 32 defines a second sleeving portion 324. Each second sleeving portion 324 is sleeved on a corresponding second fixing shaft 36.

The second fixing shafts 36 are fixedly arranged between the second upper cover plate 24 and the second lower cover plate 26. The second end of each of the elastic bands 32 defines the second sleeving portion 324. Each second sleeving portion 324 is sleeved on the corresponding second fixing shaft 35, so that the second end of each of the elastic bands 32 is arranged in the lower clamping plate 20. The two second fixing shafts 36 are respectively arranged in the two second portions 22 of the lower clamping plate 20. Correspondingly, the second end of each of the elastic bands 32 is fixed in a corresponding second portion 22 of the lower clamping plate 20.

Specifically, the second end of each of the elastic bands 32 may be partially overlapped to form each second sleeving portion 324. An area of a overlapping portion of each of the elastic bands 32 close to the first end thereof is fixedly connected to the elastic band thereof. An area of the overlapping portion of each of the elastic bands 32 away from the first end thereof is configured to sleeve a corresponding second fixing shaft 36. The area of the overlapping portion of each of the elastic bands 32 close to the first end thereof is fixedly connected to the elastic band thereof by stitching, gluing, hot-melt fixing, etc.

Figure 8:
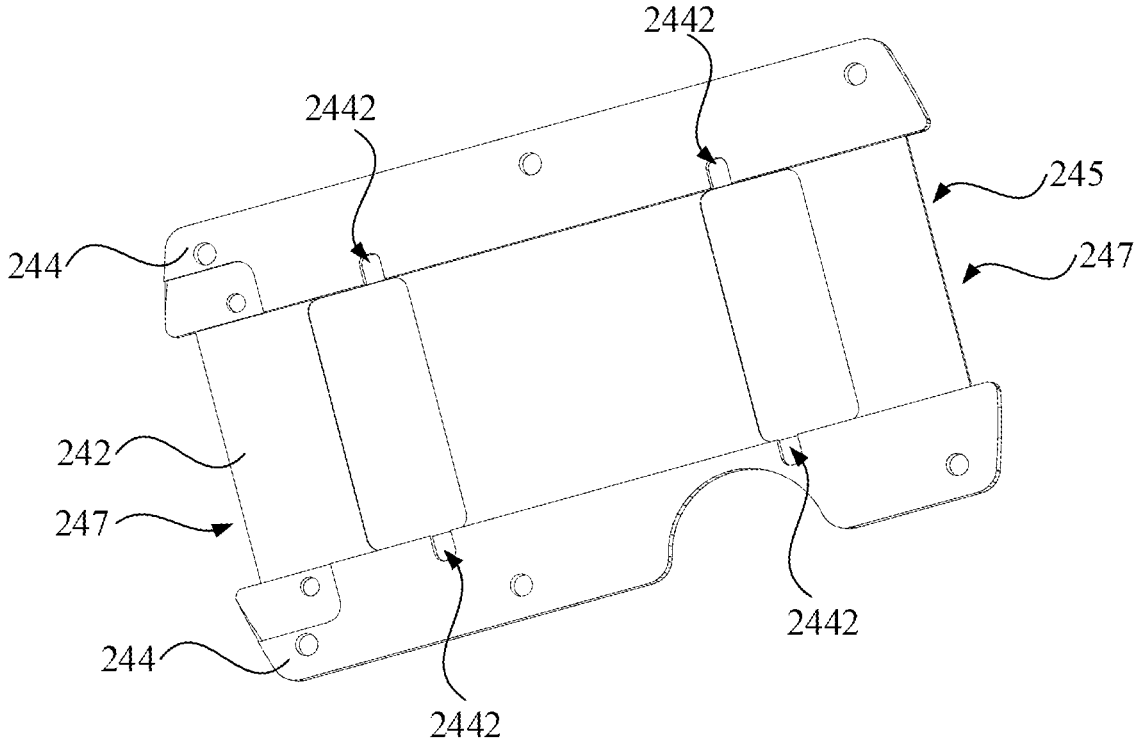
FIG. 8 is a schematic diagram of a second upper cover plate of the card clip shown in FIG. 3.

As shown in FIG. 8, FIG. 8 is a schematic diagram of the second upper cover plate of the card clip shown in FIG. 3. In some embodiments, the second upper cover plate 24 comprises a second bottom portion 242 and two second protrusion portions 244. The two second protrusion portions 244 are arranged on two opposite sides of the second bottom portion to form a second groove 245. The second end of each of the elastic bands 32 is arranged in the second groove 245. Each of the second protrusion portions 244 defines two second accommodating ports 2442 opposite to each other. Each of the second accommodating ports 2442 is corresponding to a corresponding second fixing shaft 36. Two ends of each of the second fixing shafts 36 extend from a corresponding elastic band 32 and are separately clamped in a corresponding second accommodating port 2442. Thus, the second fixing shafts 36 are stably and reliably fixed between the second lower cover plate 26 and the second upper cover plate 24.

It should be understood that each two second accommodating ports 2442 arranged opposite to each other have a certain distance from edges of the second bottom portion 242, i.e., a portion of each of the elastic bands 32 arranged in the lower clamping plate 20 has a certain length. When the upper clamping plate 10 and the lower clamping plate 20 are opened through the elastic bands 32, the length of each of the elastic bands 32 being stretched is fixed. The longer each of the elastic bands 32 is, the longer a stretching length of each of the elastic bands 32 is, which is convenient for the user to open the card clip 1 for the large angle, and prevents the elastic bands 32 from excessively stretching to protect the elastic bands 32.

In some embodiments, two ends of the first lower cover plate 16 define first notches 163. Two ends of the second upper cover plate 24 define second notches 247. Each of the elastic bands 32 passes through a corresponding first notch 163 and a corresponding second notch 247, so that each of the elastic bands 32 does not exceed the first upper cover plate 14 and the second lower cover plate 26. When the card clip 1 is closed, the elastic bands 32 is invisible, which protects the elastic bands 32, avoids contact between the elastic bands 32 and external items, avoids damage to the elastic bands 32, and makes an appearance of the card clip 1 beautiful.

As shown in FIG. 3, in some embodiments, the lower clamping plate 20 further comprises a plurality of second fixing pieces 29. The second upper cover plate 24 is fixedly connected to the second lower cover plate 26 by the plurality of second fixing pieces 29. The plurality of second fixing pieces 29 may be arranged according to requirements. For example, the plurality of second fixing pieces 29 may be screws, rivets, or other components. For example, the second upper cover plate 24 and the second lower cover plate 26 correspondingly define threaded holes, and the screws are screwed to connect the threaded holes of the second upper cover plate 24 with the threaded holes of the second lower cover plate 26, thereby fixedly connecting the second upper cover plate 24 with the second lower cover plate 26. Alternatively, through holes are defined on the second lower cover plate 26 and threaded holes corresponding to the through holes are defined on the second upper cover plate 24. The screws respectively pass through the through holes of the second lower cover plate 26 and are respectively screwed with the threaded holes of the second upper cover plate 24, thereby fixedly connecting the second upper cover plate 24 with the second lower cover plate 26.

Figure 9:
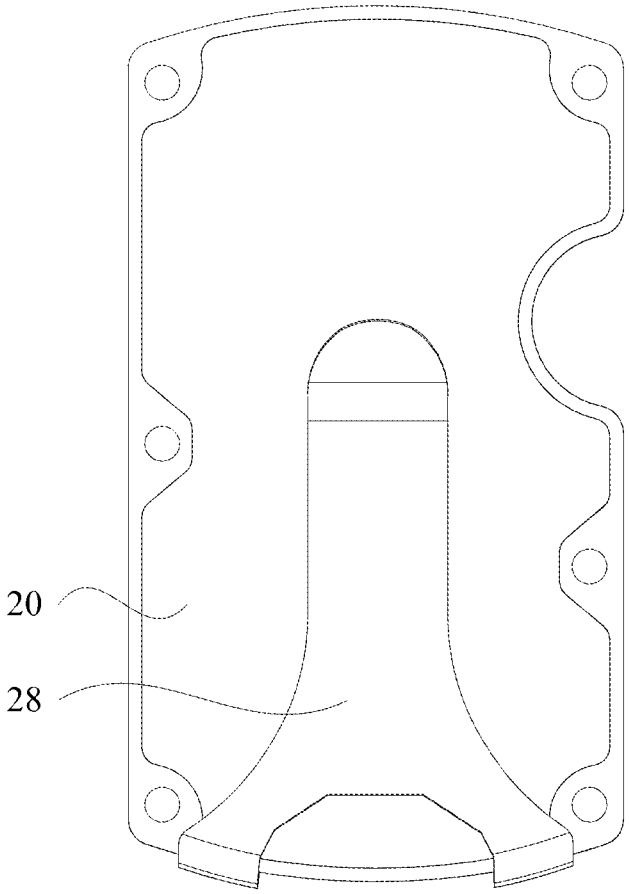
FIG. 9 is a schematic diagram of the card clip shown in FIG. 1.
Figure 10:
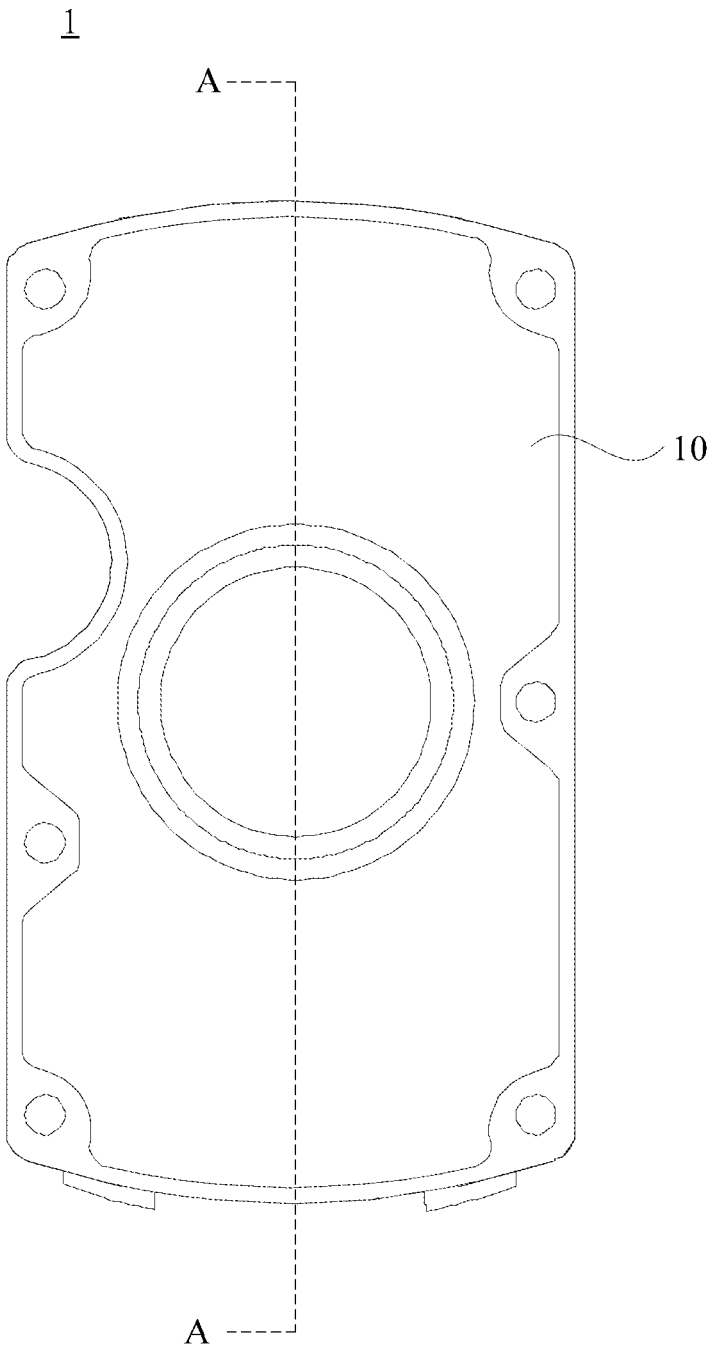
FIG. 10 is another schematic diagram of the card clip shown in FIG. 1.
Figure 11:
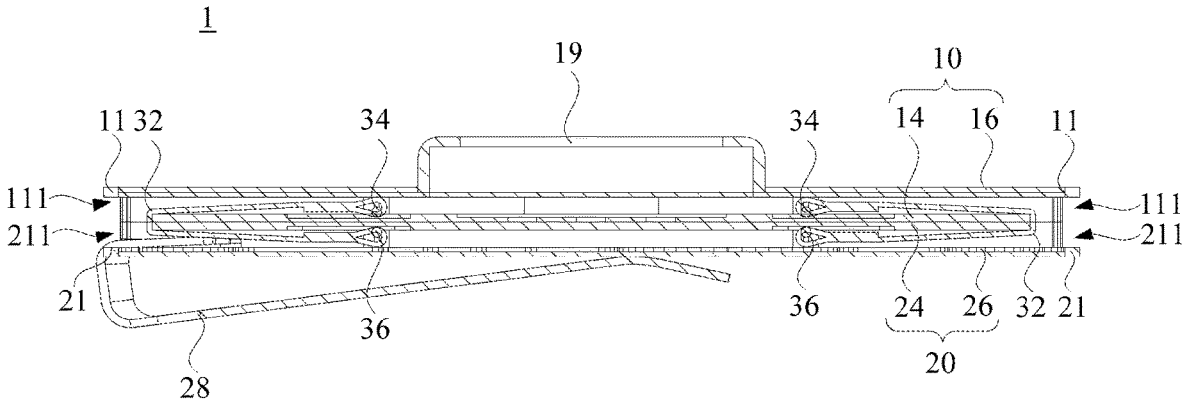
FIG. 11 is a cross-sectional schematic diagram taken along the line A-A shown in FIG. 10.

As shown in FIGS. 9-11, FIG. 9 is a schematic diagram of the card clip shown in FIG. 1, FIG. 10 is another schematic diagram of the card clip shown in FIG. 1, and FIG. 11 is a cross-sectional schematic diagram taken along the line A-A shown in FIG. 10. In some embodiments, the lower clamping plate 20 further comprises a clamping structure 28. The clamping structure 28 is arranged on one side of the second lower cover plate 26 away from the second upper cover plate 24. A first end of the clamping structure 28 is fixedly connected to the second lower cover plate 26. A second end of the clamping structure 28 elastically abuts against the second lower cover plate 26.

The clamping structure 28 cooperates with the second lower cover plate 26, so that the card clip is clipped to a clipped item provided by the user. For example, the clamping structure 28 cooperates with the second lower cover plate 26 to clip the card clip 1 to the user's clothing, pants, a backpack, a satchel, a handbag, or other items.

In some embodiments, the upper clamping plate 10 comprises two first end portions 11 arranged opposite to each other. Each of the first end portions 11 defines a first opening 111. Each of the elastic bands 32 passes through a corresponding first opening 111. The lower clamping plate 20 comprises two second end portions 21 arranged opposite to each other. Each of the second end portions 21 defines a second opening 211. Each of the elastic bands 32 passes through a corresponding second opening 211.

The first end of each of the elastic bands 32 extends into the upper clamping plate 10 from a corresponding first opening 111 of a corresponding first end portion 11 of the upper clamping plate 10. The second end of each of the elastic bands 32 extends into the lower clamping plate 20 from a corresponding second opening 211 of a corresponding second end portion 21 of the lower clamping plate 20. The elastic bands 32 may also be fixedly connected to the upper clamping plate 10 and the lower clamping plate 20 by other methods. For example, first snapping structures are arranged on two sides of the upper clamping plate 10 corresponding to the elastic bands 32. The first end of each of the elastic bands 32 is fixed in the upper clamping plate 10 through corresponding first snapping structures. Similarly, second snapping structures are arranged on two sides of the lower clamping plate 10 corresponding to the elastic bands 32. The second end of each of the elastic bands 32 is fixed in the lower clamping plate 20 through corresponding second snapping structures. Alternatively, the snapping structures may comprise a plurality of tip portions, and the plurality of tip portions are snapped on the elastic bands 32. Alternatively, the upper clamping plate 10 comprises the first upper cover plate 14 and the first lower cover plate 16. The first upper cover plate 14 and the first lower cover plate 16 respectively comprise a pressing portion, the first upper cover plate 14 and the first lower cover plate 16 are fixed by the screws, and the two pressing portions press the elastic bands 32 from two sides thereof, so as to firmly clamp the elastic bands 32.

As shown in FIG. 2, in some embodiments, an edge of the upper clamping plate 10 defines a first card taking notch 13 configured to expose parts of the cards. Thus, the user can easily take out the cards from the first card taking notch 13. A shape of the first card taking notch 13 is determined according to requirements. For example, the first card taking notch 13 is arc-shaped, semi-circular, semi-elliptical, or other shapes. It is noted that the cards clamped in the card clip 1 are pushed from the first card taking notch 13 to push the cards out from an opposite side of the first card taking notch 13 of the card clip 1. That is, the upper clamping plate 10 defines two opposing sides (i.e., left side and right side of the upper clamping plate, an edge of one side of the upper clamping plate 10 defines the first card taking notch 13, and the cards are pushed from the first card taking notch 13 and are pushed out from the other side of the upper clamping plate 10.

In some embodiments, an edge of the lower clamping plate 20 defines a second card taking notch 23 arranged corresponding to the first card taking notch 13. The upper clamping plate 10 and the lower clamping plate 20 define the first card taking notch 13 and second card taking notch 23 corresponding to each other, which facilitates the user to take out the cards from two sides respectively. It should be noted that the cards clamped in the card clip 10 can be pushed out from the first card taking notch 13 and/or the second card taking notch 23. The cards are pushed out from the opposite side of the first card taking notch 13 and the opposite side of the second card taking notch 23 of the card clip 1. That is, the card clip 1 comprises two opposite sides. An edge of one side of the card clip 1 defines the first card taking notch 13 and the second card taking notch 23, and the cards are pushed from the first card taking notch 13 and the second card taking notch 23 and are pushed out from the other side of the card clip 1.

In some embodiments, an edge of the lower clamping plate 20 defines the second card taking notch 23 configured to expose parts of the cards. There is no first card taking notch 13 on the upper clamping plate 10 and there is the second card taking notch 23 on the lower clamping plate 20. Therefore, the user can easily take out the cards from the second card taking notch 23 while the upper clamping plate 10 well supports the cards. It should be noted that the cards clamped in the card clip 10 can be pushed out from the second card taking notch 23. The cards are pushed out from the opposite side of the second card taking notch 23 of the card clip 1. That is, the lower clamping plate 20 comprises two opposite sides. An edge of one side of the lower clamping plate 20 defines the second card taking notch 23, and the cards are pushed from the second card taking notch 23 and are pushed out from the other side of the lower clamping plate 20.

In some embodiments, the user can also push the upper clamping plate 10 upwards from one corner of the upper clamping plate 10 with fingers. Since friction is generated on the one corner of the upper clamping plate 10, the cards clamped in the card clip 1 are partially pushed out, and the user can quickly push the cards to make the cards fan out, making it easy for the user to quickly select a desired card.

In some embodiments, elastic bands are selected according to requirements. E.g., each of the elastic bands 32 is selected from an elastic webbing, a silicone elastic band, a latex elastic band, and a rubber elastic band.

Figure 12:
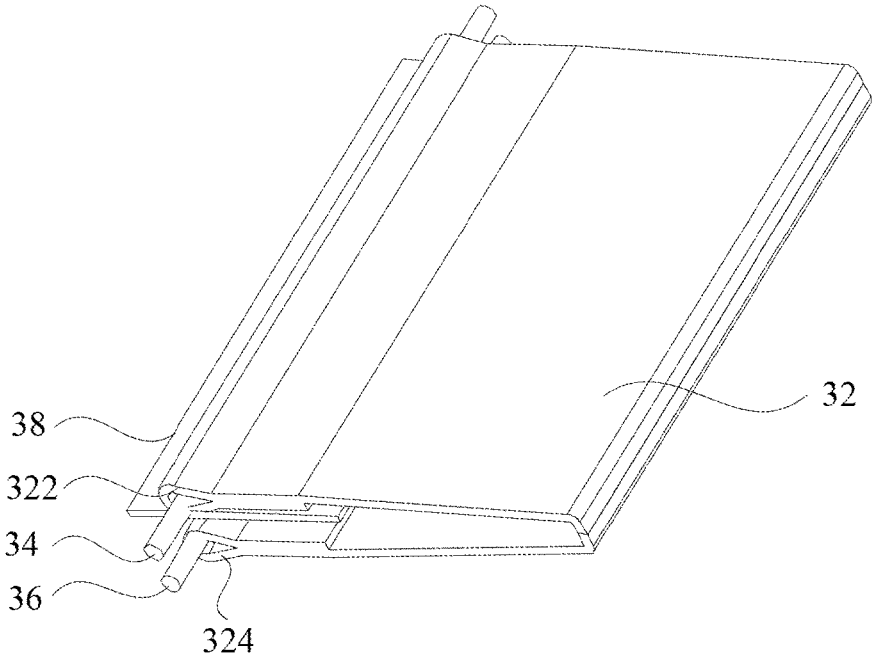
FIG. 12 is another schematic diagram of the elastic band and the matching structure thereof according to one embodiment of the present disclosure.

In some embodiments, as shown in FIG. 12, FIG. 12 is another schematic diagram of the elastic band and the matching structure thereof according to one embodiment of the present disclosure. The card clip 1 further comprises steel plates 38. The steel plates 38 are arranged between the first upper cover plate 14 and the first lower cover plate 16. Each of the steel plates 38 is arranged between a corresponding first fixing shaft 34 and the first upper cover plate 14. It is understood that after each of the first fixing shafts 34 is arranged in the corresponding first groove 165 and the corresponding first accommodating port 1642 defined on the first lower cover plate 16, and each of the steel plates 38 covers each of the first fixing shafts 34 to fix each of the first fixing shafts 34 to the first lower cover plate 16.

The embodiments, implementations and related technical features of the present disclosure can be combined and replaced with each other without conflict.

In addition, terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified.

The above embodiments of the present disclosure provide a detailed illustration to the card clip. In the present disclosure, specific embodiments are applied to illustrate the principles and implementations of the present disclosure. The above description of the embodiments is only used to better understand methods and core ideas of the present disclosure. Meanwhile, according to the ideas of the present disclosure, changes are made in the specific implementations and the application scope by those skilled in the art. Therefore, the contents of the specification should not be regarded as a limitation of the present disclosure.

What is claimed is:

1. A card clip configured to accommodate cards, comprising:

an upper clamping plate, a lower clamping plate, and two elastic bands;

wherein the upper clamping plate comprises two first portions arranged opposite to each other; the lower clamping plate is arranged against the upper clamping plate; the lower clamping plate comprises two second portions arranged opposite to each other; the two second portions are respectively corresponding to the two first portions;

wherein the two elastic bands are arranged on two opposite sides of the card clip, a first end of each of the elastic bands is fixedly arranged in a corresponding first portion, and a second end of each of the elastic bands is fixedly arranged in a corresponding second portion;

wherein the upper clamping plate comprises a first upper cover plate and a first lower cover plate;

wherein the card clip further comprises two first fixing shafts; each of the first fixing shafts is fixedly arranged between the first upper cover plate and the first lower cover plate; the first end of each of the elastic bands defines a first sleeving portion; and each first sleeving portion is sleeved on a corresponding first fixing shaft.

2. The card clip according to claim 1, wherein the first lower cover plate comprises a first bottom portion and two first protrusion portions; the two first protrusion portions are arranged on two opposite sides of the first bottom portion to form a first groove; the first end of each of the elastic bands is arranged in the first groove;

wherein each of the first protrusion portions defines two first accommodating ports opposite to each other; each of the first accommodating ports is corresponding to a corresponding first fixing shaft; two ends of each of the first fixing shafts extend from a corresponding elastic band and are separately clamped in a corresponding first accommodating port.

3. The card clip according to claim 2, wherein an accommodating groove is defined on the first bottom portion; the first upper cover plate covers the accommodating groove.

4. The card clip according to claim 3, wherein accommodating through holes are defined on the first bottom portion; the accommodating through holes are corresponding to the accommodating groove.

5. The card clip according to claim 3, wherein the card clip further comprises a decorative piece; the decorative piece is accommodated in the accommodating groove.

6. The card clip according to claim 3, wherein the card clip further comprises an electronic tag; the electronic tag is arranged in the accommodating groove.

7. The card clip according to claim 3, wherein the upper clamping plate further comprises an annular protrusion; the annular protrusion is arranged on one side of the first upper cover plate away from the first lower cover plate; the annular protrusion is arranged corresponding to the accommodating groove.

8. The card clip according to claim 1, wherein the upper clamping plate further comprises a plurality of first fixing pieces; the first upper cover plate is fixedly connected to the first lower cover plate by the plurality of first fixing pieces.

9. The card clip according to claim 1, wherein the upper clamping plate further comprises an annular protrusion, the annular protrusion is arranged on one side of the first upper cover plate away from the first lower cover plate; the annular protrusion and the first upper cover plate form a storage groove.

10. The card clip according to claim 1, wherein the lower clamping plate comprises a second upper cover plate and a second lower cover plate; the card clip further comprises two second fixing shafts, each of the second fixing shafts is fixedly arranged between the second upper cover plate and the second lower cover plate; the second end of each of the elastic bands defines a second sleeving portion; each second sleeving portion is sleeved on a corresponding second fixing shaft.

11. The card clip according to claim 10, wherein the second upper cover plate comprises a second bottom portion and two second protrusion portions; the two second protrusion portions are arranged on two opposite sides of the second bottom portion to form a second groove; the second end of each of the elastic bands is arranged in the second groove;

wherein each of the second protrusion portions defines two second accommodating ports opposite to each other; each of the second accommodating ports is corresponding to a corresponding second fixing shaft; two ends of each of the second fixing shafts extend from a corresponding elastic band and are separately clamped in a corresponding second accommodating port.

12. The card clip according to claim 11, wherein two ends of the first lower cover plate define first notches; two ends of the second upper cover plate define second notches; each of the elastic bands passes through a corresponding first notch and a corresponding second notch, so that each of the elastic bands does not exceed the first upper cover plate and the second lower cover plate.

13. The card clip according to claim 10, wherein the lower clamping plate further comprises a clamping structure; the clamping structure is arranged on one side of the second lower cover plate away from the second upper cover plate; a first end of the clamping structure is fixedly connected to the second lower cover plate; a second end of the clamping structure elastically abuts against the second lower cover plate.

14. The card clip according to claim 10, wherein the lower clamping plate further comprises a plurality of second fixing pieces; the second upper cover plate is fixedly connected to the second lower cover plate by the plurality of second fixing pieces.

15. The card clip according to claim 1, wherein an edge of the upper clamping plate defines a first card taking notch configured to expose parts of the cards.

16. The card clip according to claim 15, wherein an edge of the lower clamping plate defines a second card taking notch arranged corresponding to the first card taking notch.

17. The card clip according to claim 15, wherein an edge of the lower clamping plate defines a second card taking notch configured to expose parts of the cards.

18. The card clip according to claim 1, wherein each of the elastic bands is selected from an elastic webbing, a silicone elastic band, a latex elastic band, and a rubber elastic band.

19. A card clip configured to accommodate cards, comprising:

an upper clamping plate, a lower clamping plate, and two elastic bands;

wherein the upper clamping plate comprises two first portions arranged opposite to each other; the lower clamping plate is arranged against the upper clamping plate; the lower clamping plate comprises two second portions arranged opposite to each other; the two second portions are respectively corresponding to the two first portions;

wherein the two elastic bands are arranged on two opposite sides of the card clip, a first end of each of the elastic bands is fixedly arranged in a corresponding first portion, and a second end of each of the elastic bands is fixedly arranged in a corresponding second portion;

wherein the upper clamping plate comprises two first end portions arranged opposite to each other; each of the first end portions defines a first opening; each of the elastic bands passes through a corresponding first opening; and wherein the lower clamping plate comprises two second end portions arranged opposite to each other; each of the second end portions defines a second opening; each of the elastic bands passes through a corresponding second opening.

* * * * *